United States Patent [19]

Maloney

[11] 4,166,519

[45] Sep. 4, 1979

[54] SKATEBOARD BRAKE

[76] Inventor: Michael J. Maloney, 4800 Oxborough La., Bloomington, Minn. 55437

[21] Appl. No.: 896,242

[22] Filed: Apr. 14, 1978

Related U.S. Application Data

[63] Continuation of Ser. No. 756,138, Jan. 3, 1977, abandoned.

[51] Int. Cl.[2] ..... B60T 1/04; A63C 17/14

[52] U.S. Cl. ..... 188/29; 188/2 R; 280/11.2

[58] Field of Search ..... 188/2 R, 19–22, 188/29, 74, 250 R, 250 B; 280/11.2

[56] References Cited

U.S. PATENT DOCUMENTS

| | | | |
|---|---|---|---|
| 321,261 | 6/1885 | Turnbull | 280/11.2 |
| 862,849 | 8/1907 | Rumble | 280/11.2 |
| 3,811,535 | 5/1974 | Preusser | 188/29 |

*Primary Examiner*—Duane A. Reger

*Attorney, Agent, or Firm*—Merchant, Gould, Smith, Edell, Welter & Schmidt

[57] ABSTRACT

The present invention is a brake for free-wheeling ground engaging vehicles, in particular skateboards. The brake includes a bracket which can be easily mounted to the bottom surface of the skateboard. Pivotally mounted to the bracket is a lever to which is secured brake shoes. The lever is biased by gravitational force to a first position in which the brake shoes are disengaged from the wheels. The lever is positioned for actuation by the rider of the skateboard such that the lever will be rotated to a second position in which the brake shoes engage the wheels.

10 Claims, 5 Drawing Figures

SKATEBOARD BRAKE

This is a continuation, of application Ser. No. 756,138, filed Jan. 3, 1977, now abandoned.

BACKGROUND OF THE INVENTION

The present invention relates generally to an apparatus for braking a free-wheeling vehicle, and more particularly, to a braking apparatus for a skate board.

The rapidly increasing number of serious injuries to skate board users is the cause of considerable concern among members of the medical profession and laymen as well. Such injuries result in large part from the fact that the skateboards are free-wheeling vehicles which can achieve a significant rate of speed and, in general, are not provided with means for bringing the skateboard to a controlled stop. Often, in order to stop his forward progress, the skateboard rider will simply leap from the board as it is traveling at its high rate of speed. Such action, while causing numerous injuries to the rider, is also potentially dangerous to bystanders as the skateboard continues its unmanned travel becoming an unguided missile.

It has been proposed to provide boards with braking pads attached to the rear of the board so that by shifting his weight to the rear of the board the rider can bring the braking pad into frictional engagement with the ground while raising the front wheels from the ground. This operation can be extremely precarious as the board is pivoted about its rear wheels into an essentially three-point contact with the ground. This operation is difficult to perform by the experienced rider and can therefore significantly increase the injury possibilities to one less skilled in skate board riding techniques.

Additionally, a number of prior art braking devices have been proposed, however, none of the proposed structures has met with success because of problems that each has. Among these proposed structures are those which have brake shoes or pads that are biased into engagement with the skateboard wheels. A brake lever, therefore, must be continually manually actuated by the skateboard rider to maintain the brake shoes disengaged from the wheels. Such devices significantly limit the position which the skateboard rider may assume on the board and are therefore particularly undesirable. Additionally, a number of the prior art braking devices have springs to bias the device into or out of engagement with the skateboard wheels. Under prolonged use, the springs tend to somewhat lose their biasing force, altering the handling characteristics of the brake. Additionally, the biasing springs may become disengaged entirely from the brake, resulting in a brake malfunction. Finally, typically the prior art braking devices are not readily adaptable to existing skateboards. On the contrary, the prior art braking devices incorporate substantial modifications to the conventional skateboard structure.

The present invention overcomes the disadvantages of the prior art braking devices in that it provides a simple, low-cost braking device which can be easily mounted to existing skateboards with a minimal amount of modification to the existing skateboard structure. In particular, to mount the present invention on existing skateboards, one must simply drill apertures in the board to receive the braking device fasteners. The present invention is also gravity biased, eliminating the need for springs that have the above discussed disadvantages.

SUMMARY OF THE INVENTION

The present invention is an apparatus for braking a free-wheeling, ground engaging vehicle having a platform with a top surface for supporting a rider and a bottom surface to which is secured ground engaging wheels. The apparatus includes a bracket secured to the bottom surface of the platform to which is pivotally mounted a lever having a first arm positioned for actuation by the rider and a second arm to which are secured brake shoes located proximate the wheels of the vehicle. The lever is rotatable between the first and second positions and the pivotal axis of the lever is disposed so that the gravitational force acting on the lever provides a rotational moment to the lever to bias the lever toward the first position in which the brake shoes are disengaged from the wheels. The operator by actuating the first arm rotates the lever to the second position in which the brake shoes frictionally engage the wheels, slowing the forward travel of the vehicle.

In one embodiment, the bracket has a substantially flat top surface which mates with the bottom surface of the skateboard and is provided with a channel recess that receives the base of the substantially U-shaped second arm of the pivotally mounted lever. The first arm of the lever extends generally upward above the plane of the platform of the vehicle and is positioned proximate the lateral edge of the platform. In this position, the first arm can be easily actuated by the vehicle rider and at the same time the rider can assume various positions on the vehicle.

These and other advantages of the present invention will become apparent with reference to the drawings, detailed description of the preferred embodiment, and claims.

DETAILED DESCRIPTION OF THE PREFERRED EMBODIMENT

Figure 1:
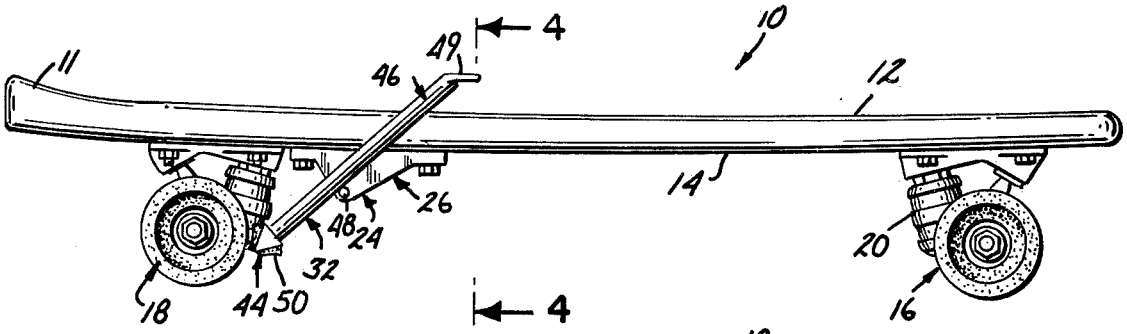
FIG. 1 is a side elevation view of a vehicle embodying the braking apparatus of the present invention.

Referring to the drawing, wherein like numerals represent like parts throughout the several views, there is shown a skate board 10 having a platform 11 with a top surface 12 and a bottom surface 14. Platform 11 is supported by pairs of front and rear ground engaging wheels 16 and 18, respectively. Front and rear wheel pairs 16 and 18 are secured to bottom surface 14 of platform 11 by shock absorbing mechanisms 20 and 22, respectively.

Figure 3:
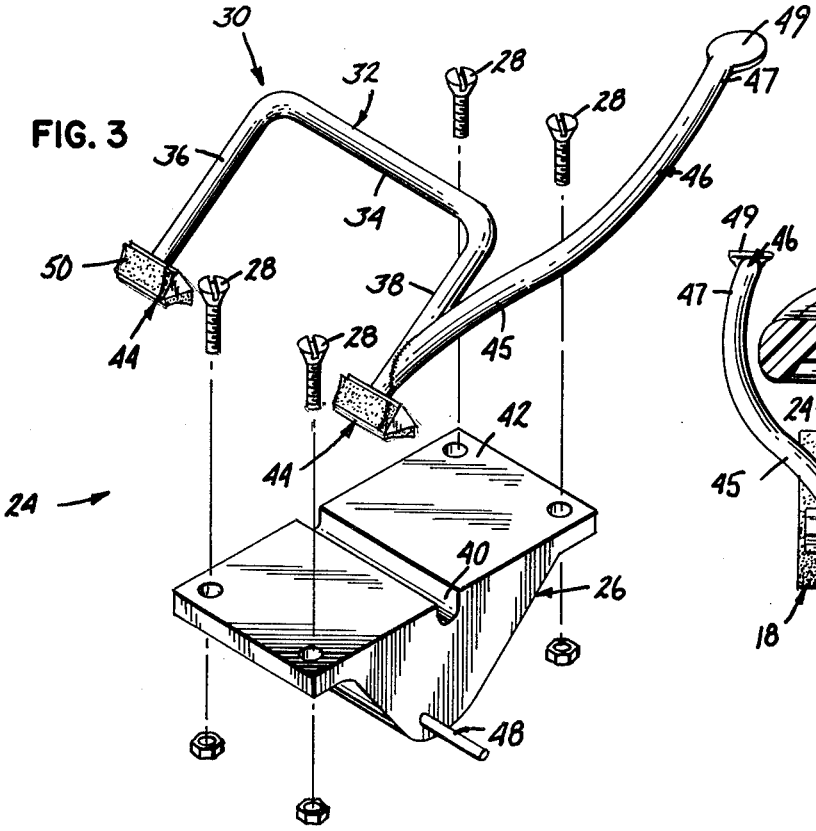
FIG. 3 is an exploded perspective view of the braking apparatus of the present invention.
Figure 4:
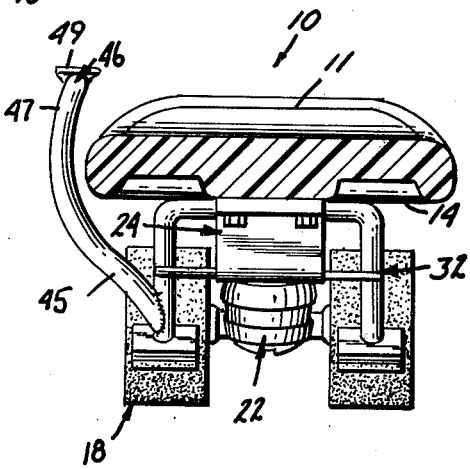
FIG. 4 is a sectional view taken along the line 4—4 of FIG. 1.

The braking apparatus of the present invention is designated generally at 24. Braking apparatus 24 includes a bracket 26 which is secured to bottom surface 14 of platform 11 by a plurality of fasteners 28. Rotatably mounted to bracket 26 is a brake lever 30. In the preferred embodiment, brake lever 30 includes a U-shaped member 32 having a base 34 and a pair of legs 36 and 38. As shown more particularly in the exploded perspective view of FIG. 3, bracket 26 has a channel or groove 40 formed therein which rotatably receives base 34 of member 32. In the embodiment illustrated in FIG. 3, base 34 is held captive within channel 40 by bottom surface 14 which mates with a top substantially flat surface 42 of bracket 26.

Figure 2:
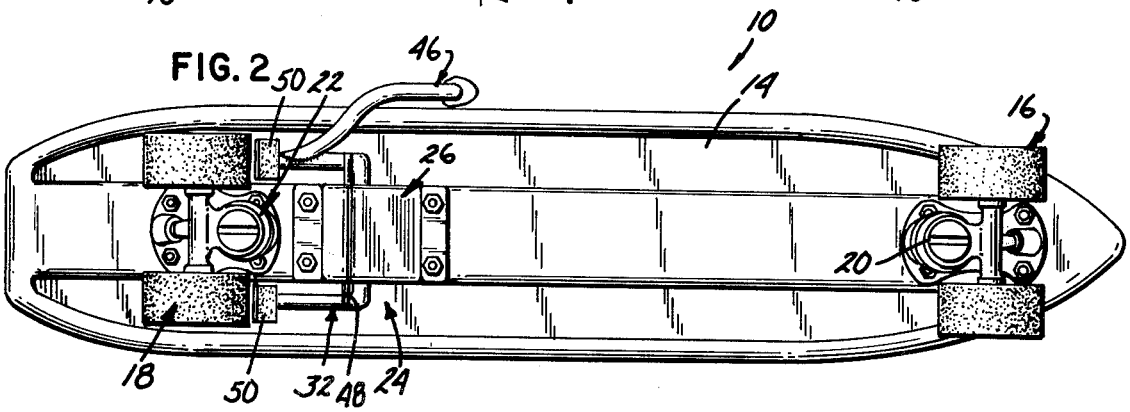
FIG. 2 is a bottom plan view of the vehicle depicted in FIG. 1.

Secured at the ends of legs 36 and 38 are brake shoes 44 provided with brake pads 50 disposed so as to selectively frictionally engage wheels 18. Brake pads 50 have a surface with a curvature to compliment the curvature of wheels 18. Integral with leg 38 is a lever arm 46 which extends above the plane of top surface 12 of platform 11 and is proximate the lateral edge of platform 11 as seen more particularly in FIG. 2. Lever arm 46 has a first portion 45 extending generally outward and upward from leg 38 and a second portion 47 extending generally upward above the plane of surface 12 and which terminates in an actuating pedal 49. Lever arm 46 is thus positioned to be actuated by the rider of skateboard 10. Stops 48 project outward from bracket 26 into the rotational path of legs 38 and 36. Thus, stops 48 will limit the rotation of lever 30 in the counter-clockwise direction as depicted in FIG. 1.

Brake pads 50 are provided on opposite sides of brake shoes 44 so that lever 30 can be positioned with arm 46 on the opposite side of board 10 from the position shown in the drawing. The brake apparatus 24 can thus be used by both "right" and "left" foot skateboard riders. The conversion from "right" to "left" is made by simply removing bracket 26, inserting base 34 into channel 40 so that lever arm 45 is on the opposite side of bracket 26 from that shown in the drawing, and securing bracket 26 to board 10.

Figure 5:
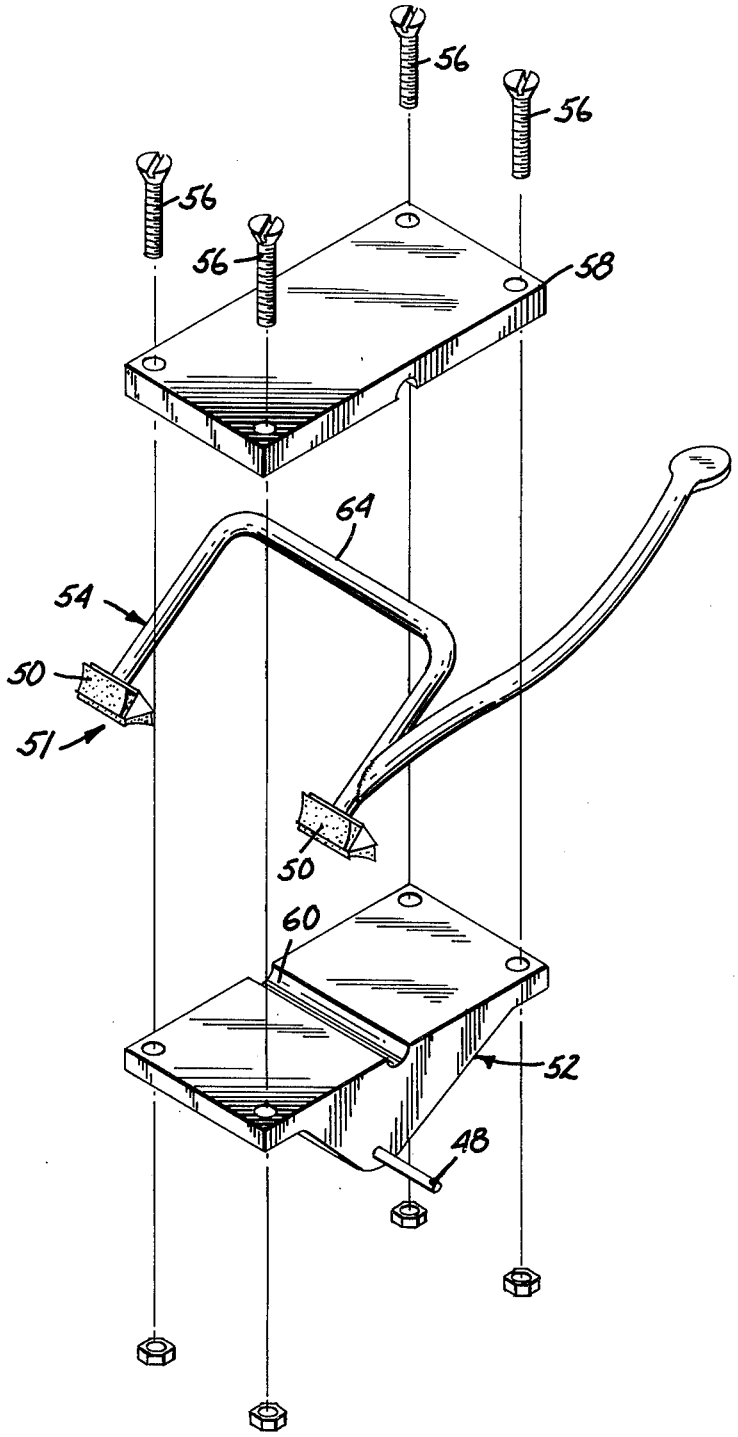
FIG. 5 is an exploded perspective view of an alternative embodiment of the present invention.

An alternative embodiment of the present invention is illustrated in FIG. 5. Braking apparatus 51 includes a bracket 52, a lever 54 and fasteners 56, each of which is substantially the same as the corresponding elements of braking apparatus 24. Apparatus 50 is provided with an additional retaining plate 58. Bracket 52 has a channel 60 which cooperates with a channel 62 in plate 58 to rotatably capture base 64 of lever 54. Fasteners 56 secure plate 58 to bracket 52 in addition to securing braking apparatus 50 to board 10. The structure of apparatus 50 is of particular use with boards having irregular bottom surfaces that would not effectively capture base 32 in channel 40 as shown in FIGS. 1–4.

The braking apparatus bracket and lever may be formed of plastic or metal materials. Brake pads 50 would preferably be of a material which would frictionally engage wheels 18 and yet not wear away the wheel material which is typically urethane.

The operation of the present invention will now be described with reference to FIGS. 1–4. The gravitational force on 1 lever 30 creates a moment about the pivotal axis of base 34 in a counter-clockwise direction toward a first position in which leg 38 engages stop 48 and brake pads 45 are disengaged from wheels 18. When the rider desires to slow the travel of skateboard 10, he simply depresses lever arm 46 rotating brake lever 30 in clockwise direction whereby brake pads 45 frictionally engage wheels 18.

It can be seen that the brake 24 can easily be adapted to any of the present commercially available skateboards. All that is required would simply be apertures drilled in platform 11 for the insertion of fasteners 28. The present invention is, thus, a simple and low-cost brake which can be applied to any of the presently sold skateboards. By eliminating the biasing spring associated with a number of the prior art devices, not only is cost minimized but potential mechanical failures are eliminated. Additionally, as opposed to a number of the prior art devices that require continued depression of a brake lever to release a brake which is normally biased into engagement with the wheels, the present invention allows unrestricted movement of the skateboard rider about the board since the brake is normally biased gravitationally out of engagement with the wheels requiring actuation by the rider in order to bring the skateboard to a stop.

I claim:

1. In combination with a free-wheeling ground engaging vehicle having a platform, a top surface for supporting a rider, a bottom surface to which is secured platform suspension and support members, and lateral edges, said support members having ground engaging wheels, apparatus for braking said vehicle comprising:

a bracket releasably attached to the bottom surface of said platform and spaced apart from said suspension and support members along said bottom surface;

a lever pivotally mounted to said bracket for rotation between first and second positions, said lever having a first arm extending above said top surface and proximate one of the lateral edges of said platform for actuation by said rider and a second arm to which is secured a frictional braking member disposed proximate said wheels, said frictional braking member having first and second oppositely disposed sides, said first side disposed on said braking member to selectively engage said wheels with said first arm disposed proximate one of the lateral edges while said second side remains disengaged, said second side disposed on said braking member to selectively engage said wheels with said first arm proximate the other of the lateral edges while said first side remains disengaged, each of said first and second sides having wheel engagement surfaces, said selected oppositely disposed side disengaged from said wheels in said first lever position and frictionally engaged with said wheels in said second lever position, said pivot axis of said lever disposed so that the force of gravity acting on said second arm provides a moment to said lever to bias said lever toward said first position;

whereby said rider by actuating said first arm rotates said lever to said second position causing one of said wheel engagement surfaces to frictionally engage said wheels.

2. Apparatus in accordance with claim 1 further comprising stop means secured to said bracket and positioned to engage said lever for limiting the rotation of said lever about said pivot axis under the influence of said gravitational force acting on said second arm.

3. In combination with a free-wheeling ground engaging vehicle having a platform, a top surface for supporting a rider, a bottom surface to which is secured platform suspension and support members, and lateral edges, said support members having ground engaging wheels, apparatus for braking said vehicle comprising:

a bracket releasably attached to the bottom surface of said platform and spaced apart from said suspension and support members along said bottom surface;

a lever having a first arm extending above said top surface and proximate the lateral edge of said platform and a second arm comprising a U-shaped member having a base and leg portions, said base portion pivotally mounted to said bracket for rotation between first and second positions, said leg portions having a frictional braking member disposed at the ends thereof proximate said wheels, said frictional braking member having first and second oppositely disposed sides, each of said first and second sides having wheel engagement surfaces, one of said first and second sides disengaged from said wheels and said first lever position and frictionally engaged with said wheels in said second lever position, said pivot axis of said base portion disposed so that force of gravity acting on said second arm provides a moment to said lever to bias said lever toward said first position;

stop means secured to said bracket and positioned to engage said lever for limiting the rotation of said lever about said pivot axis under the influence of said gravitational force acting on said second arm;

whereby said rider by actuating said first arm rotates said lever to said second position causing said one of said first and second surfaces to frictionally engage said wheels.

4. Apparatus in accordance with claim 3 wherein said first arm is formed integrally with one of said leg portions of said second arm and extends above the horizontal plane of the top surface of said vehicle and proximate the lateral edge of said vehicle platform.

5. Apparatus in accordance with claim 3 wherein said bracket further comprises:

a substantially solid member secured to said vehicle by a plurality of fasteners and having formed therein a channel that rotatably receives said base portion of said second arm.

6. Apparatus in accordance with claim 5 further comprising:

a plate having a channel formed in one surface thereof, said plate secured to said substantially solid member so that said plate channel and said channel in said member cooperate to rotatably receive said base portion of said second arm and retain said base portion within said bracket.

7. A brake for a skateboard, said skateboard having at least one suspension and support member secured to the bottom of said skateboard and a platform with lateral edges, said suspension and support member having a pair of ground engaging wheels mounted along a common transverse axis, comprising:

a bracket releasably attached to the bottom of said skateboard and spaced apart from said suspension and support member along said bottom surface;

a frictional braking member pivotally mounted to said bracket for rotation between first and second positions, said frictional braking member having a first member pivotally secured to said bracket along a rotational axis transverse to the direction of travel of said skateboard, and a second member having first and second oppositely disposed wheel engaging surfaces, said wheel engaging surfaces disposed proximate said ground engaging wheels, a selected one of said wheel engaging surfaces disengaged from said wheels in said first position and frictionally engaged with said wheels in said second lever position, said pivotal axis of said frictional braking member disposed so that the force of gravity acting on said frictional braking member provides a moment to said frictional braking member to bias said frictional braking member toward said first position;

a lever secured to said frictional braking member and extending above the top surface of said skateboard and positioned proximate one of the lateral edges of said skateboard for manual actuation, said first wheel engaging surface disposed on said second member to selectively engage said wheels with said lever disposed proximate said one of the lateral edges while said second wheel engaging surface remains disengaged, said second wheel engaging surface disposed on said second member to selectively engage said wheels with said lever proximate the other of the lateral edges while said first wheel engaging surface remains disengaged;

whereby the rider of said skateboard, by actuating said lever, rotates said frictional braking member to said second position causing said selected one of said wheel engaging surfaces to frictionally engage said wheels.

8. Apparatus in accordance with claim 7 further comprising stop means secured to said bracket in position to engage said holder for limiting the rotation of said frictional braking member under the influence of the gravitational force thereby retaining said frictional braking member in said first position.

9. A brake for a skateboard, said skateboard having at least one suspension and support member secured to the bottom of said skateboard, said suspension and support member having a pair of ground engaging wheels mounted along a common transverse axis, comprising:

a bracket releasably attached to the bottom of said skateboard and spaced apart from said suspension and support member along said bottom surface;

a U-shaped frictional braking member having a base portion pivotally mounted to said bracket along a rotational axis transverse to the direction of travel of said skateboard for rotation between first and second positions, said frictional braking member having leg members each of which includes first and second oppositely disposed wheel engaging surfaces secured at the ends thereof, said wheel engaging surfaces disposed proximate said ground engaging wheels, said wheel engaging surfaces disengaged from said wheels in said first position and frictionally engaged with said wheels in said second lever position, said pivotal axis of said base disposed so that the force of gravity acting on frictional braking member provides a moment to said frictional braking member to bias said frictional braking member towards said first position;

a lever secured to said frictional braking member and extending above the top surface of said skateboard and positioned proximate the lateral edge of said skateboard for manual actuation;

stop means secured to said bracket in position to engage said frictional braking member for limiting the rotation of said frictional braking member under the influence of the gravitational force thereby retaining said frictional braking member in said first position;

whereby the rider of said skateboard by actuating said lever, rotates said frictional braking member to said second position causing one of said wheel engaging surfaces to frictionally engage said wheels.

10. Apparatus in accordance with claim 9 wherein said bracket comprises a substantially solid member secured to said skateboard by a plurality of fasteners and having a channel formed therein for rotatably receiving said base of said U-shaped frictional braking member structure.

* * * * *